US008030584B2

(12) United States Patent
Lee

(10) Patent No.: US 8,030,584 B2
(45) Date of Patent: Oct. 4, 2011

(54) SIDE KEY MODULE FOR MOBILE COMMUNICATION TERMINAL

(75) Inventor: Geun Ju Lee, Gyeonggi-do (KR)

(73) Assignee: Hanbit Precision Co., Ltd., Gyeonggi-do (KR)

( * ) Notice: Subject to any disclaimer, the term of this patent is extended or adjusted under 35 U.S.C. 154(b) by 121 days.

(21) Appl. No.: 12/587,638

(22) Filed: Oct. 8, 2009

(65) Prior Publication Data

US 2010/0140073 A1 Jun. 10, 2010

(30) Foreign Application Priority Data

Dec. 8, 2008 (KR) ..... 10-2008-0124215
Jan. 8, 2009 (KR) ..... 10-2009-0001480
Sep. 4, 2009 (KR) ..... 10-2009-0083577

(51) Int. Cl.
*H01H 9/00* (2006.01)

(52) U.S. Cl. ..... 200/292

(58) Field of Classification Search ..... 200/284, 200/292, 406, 520, 52 R, 329, 341, 512; 439/660, 439/74

See application file for complete search history.

(56) References Cited

U.S. PATENT DOCUMENTS 6,100,484 A * 8/2000 Houze et al. ..... 200/512
7,164,091 B2 * 1/2007 Lu ..... 200/292
7,576,291 B2 * 8/2009 Tseng et al. ..... 200/296
7,906,739 B2 * 3/2011 Villain et al. ..... 200/292

* cited by examiner

*Primary Examiner* — Edwin A. Leon
(74) *Attorney, Agent, or Firm* — Farjami & Farjami LLP

(57) ABSTRACT

A side key module installed at a side of a mobile communication terminal, contactly coupled up to a PCB embedded in the terminal, and simply fabricated without a soldering process. The side key module disposed between a side key installed at the side of the terminal, and the PCB installed in the terminal, including: a first plate of conductivity configured in a lengthwise form including a cut-out space and contacting with the PCB; a second plate of conductivity configured in the same plane with the first plate and disposed in the cut-out space of the first plate, contacting with the PCB; a body accommodating the first and second plates; and a metal dome joining with a side of the body and enabling the first and second plates to be electrically connected together by contacting with the first and second plates if the side key is pressed.

14 Claims, 10 Drawing Sheets

SIDE KEY MODULE FOR MOBILE COMMUNICATION TERMINAL

This application is based on and claims priority from Korean Patent Application Nos. 10-2008-0124215, 10-2009-0001480 and 10-2009-0083577 filed on Dec. 8, 2008, Jan. 8, 2009 and Sep. 4, 2009, respectively in the Korean Intellectual Property Office, the disclosure of which is incorporated herein in its entirety by reference.

BACKGROUND OF THE INVENTION

1. Field of the Invention

Exemplary embodiments relate to side key modules installed at sides of mobile communication terminals, contactly coupled up to printed circuit boards embedded in the mobile communication terminals. Particularly, the exemplary embodiments according to the present invention relate to a side key module that can be simply fabricated without a soldering process.

2. Description of the Prior Art

Mobile communication terminals are portable electronic apparatuses for enabling users to conduct wireless communication with the others. Those mobile communication terminals may be generally classified into several types, e.g., bars, folders, slides and swings, by outer shapes and operation modes.

In such a mobile communication terminal, as well as a keypad exposed on the front of the body, side keys are additionally installed at sides of the body of the terminal for the purpose of handling a camera built therein and adjusting volume of various kinds.

With the trends toward slimness, those side keys are needed to occupy smaller areas in mobile communication terminals. Nevertheless, for side key modules using tact switches, there is a limit in designing to make thickness slimmed down because they require wide areas in printed circuit boards (PCB) of mobile communication terminals due to large sizes of the tact switches.

Even with other types of side key modules using flexible PCBs (FPCB), those are inconvenient for fabrication because soldering processes should be carried out to connect the FPCBs with PCBs of mobile communication terminals.

SUMMARY OF THE INVENTION

Accordingly, the exemplary embodiments are directed to a side key module of a mobile communication terminal, which is convenient for fabrication without a soldering process.

The exemplary embodiments are also directed to a side key module of a mobile communication terminal, which is capable of strongly fixing a PCB by improving a structure of contactors meeting the PCB of the mobile communication terminal.

The exemplary embodiments are further directed to a side key module of a mobile communication terminal, which improves rigidity of contactors meeting a PCB of the mobile communication terminal.

According to exemplary embodiments, there is provided a side key module interposed between a side key, which is installed at a side of a mobile communication terminal, and a PCB set in the mobile communication terminal. The side key module may include: a first plate of conductivity configured in a lengthwise form including a cut-out space of a predetermined area and contacting with the PCB; a second plate of conductivity configured in the same plane with the first plate and disposed in the cut-out space of the first plate, contacting with the PCB; a body accommodating the first and second plates; and a metal dome joining with a side of the body and enabling the first and second plates to be electrically connected together by contacting with the first and second plates if the side key is pressed.

In an embodiment, the body may be formed in one with the first and second plates by means of an injection molding process.

In an embodiment, the first and second plates may be bended toward the PCB and have first and second contactors steadily contacting with the PCB.

In embodiments, the first contactor may be bended upward from a lower end of the first plate and the second contactor is bended downward from an upper end of the second plate, or the first contactor may be bended downward from an upper end of the first plate and the second contactor is bended upward from a lower end of the second plate. In this case, the first contactor may be formed to press an upper or lower side end of the PCB and the second contactor may be formed to press the lower or upper side end of the PCB.

In embodiments, the first and second contactors may be bended upward from lower ends of the first and second plates. In this case, the first and second contactors may be bended after completing the injection molding process for the body.

In embodiments, the body may include stepped corners formed at both top edges and guiding the side key module into the mobile communication module.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
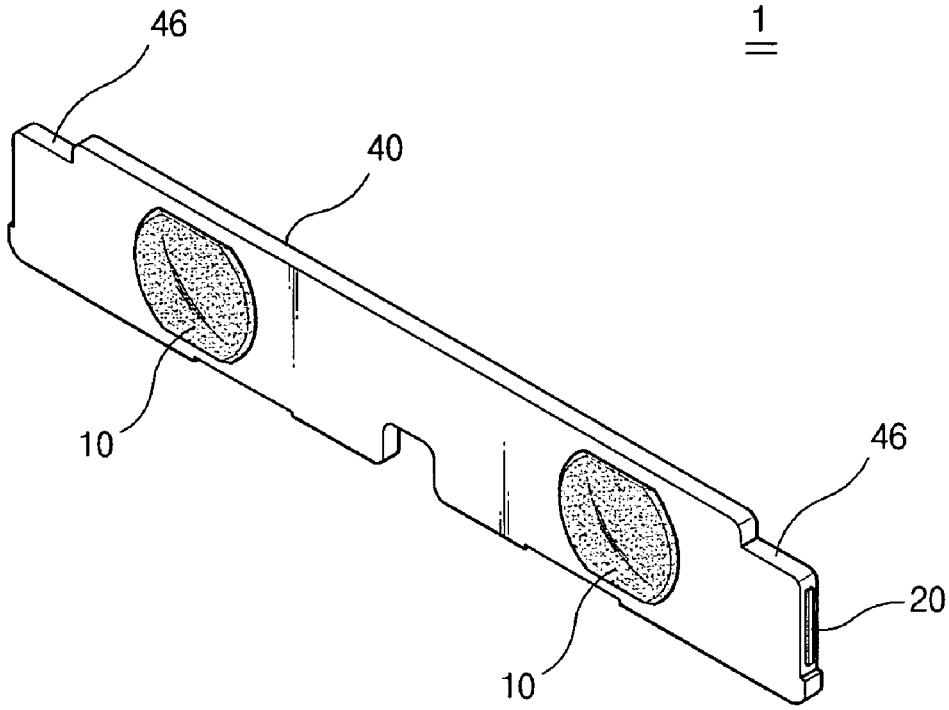
FIG. 1 is a front perspective view illustrating a side key module of a mobile communication terminal in accordance with an embodiment of the present invention.

Hereinafter, exemplary embodiments of the present invention will be described in conjunction with the accompanying drawings. The matters defined in the description, such as the detailed construction and elements, are nothing but specific details provided to assist those of ordinary skill in the art in a comprehensive understanding of the invention, and thus the present invention is not limited thereto. The same drawing reference numerals are used for the same elements throughout various figures.

Figure 2:
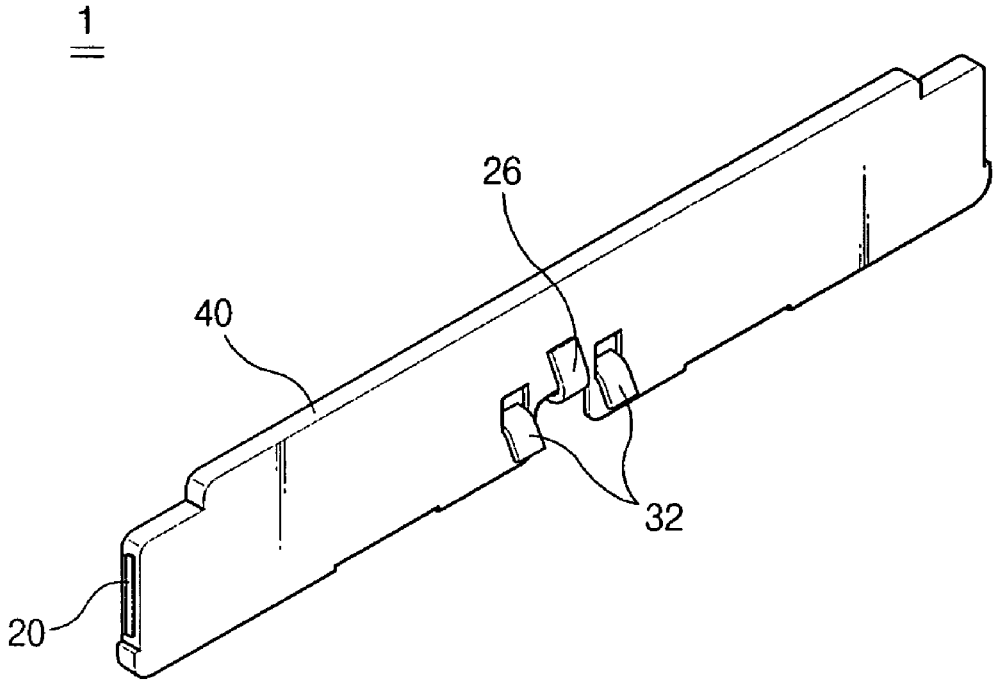
FIG. 2 is a rear perspective view of the side key module shown in FIG. 1.

FIG. 1 perspectively illustrates the front side of a side key module for a mobile communication terminal in accordance with an embodiment of the present invention. FIG. 2 perspectively illustrates the rear side of the side key module shown in FIG. 1 and FIG. 3 perspectively illustrates the inside of the side key module shown in FIG. 2. Meanwhile, FIG. 4 partly illustrates a section of the mobile communication terminal in which the side key module of FIG. 1 is installed. And, FIGS. 5A and 5B schematically illustrates directions of the force pressing a PCB by contactors of the side key module.

The side key module 1 of the mobile communication terminal is interposed between a side key 3 and a printed circuit board (hereinafter, referred to as "PCB") 5 of the mobile communication terminal. The side key module 1 functions to transfer a signal, which is generated from when a user presses the side key 3, to the PCB 5 of the mobile communication terminal.

The side key module 1 is comprised of a first plate 20, second plates 30, a body 40 and metal domes 10. The first and second plates, 20 and 30, are made up of a conductive material.

The first plate is configured lengthwise. The first plate 20 includes cut-out spaces in a predetermined area. The cut-out spaces accommodate the second plate 30, which will be described later in detail.

The first plate 20 is formed to contact with the PCB 5. The first plate 20 may have a first contactor 26 that is bended toward the PCB 5 and steadily contacting with the PCB 5.

The first contactor 26 is formed at the center of the first plate 20, being capable of contacting with a side of the PCB 5. The first contactor 26 may be bended upward from a lower end of the first plate 20, or downward from an upper end of the first plate 20. In other words, the first contactor 26 may be configured to press the upper and lower side ends of the PCB 5.

The first contactor 26 may be formed at the center of the first plate. At both sides of the first contactor 26, the cut-out spaces are arranged to permit the second plate 30 to be disposed therein. The cut-out spaces are composed of first and second cut-out spaces 22 and 24 linking together.

The second plates 30 are disposed in the first and second cut-out spaces 22 and 24 on the same plane with the first plate.

The second plates 30 are formed to contact with the PCB 5. The second plates 30 may have second contactors 32 that are bended toward the PCB 5 and steadily contacting with the PCB 5.

The second contactors 32 are formed at the center of the second plates 30, being capable of contacting with the side of the PCB 5. The second contactor 32 may be bended downward from upper ends of the second plates 30, or upward from lower ends of the second plates 30. In other words, the second contactors 32 may be configured to press the lower and upper side ends of the PCB 5.

In the meantime, the first and second contactors, 26 and 32, may be bended in opposite directions to each other. If the first contactor 26 is bended upward from the lower end of the first plate 20, the second contactors 32 are bended downward from the upper ends of the second plates 30. In this case, since the first and second contactors, 26 and 32, are pressing the upper and lower side ends of the PCB 5 to stably fix the PCB 5, it is possible to substantially prevent disconnection between the side key 3 and the PCB 5.

The second cut-out spaces 24 of the first plate 20 are configured in plane type similar to the metal domes 10, but smaller than the metal domes 10 in size. Thus, the metal domes 10 can contact with the face of the plate 20 around the second cut-out spaces 24.

Figure 3:
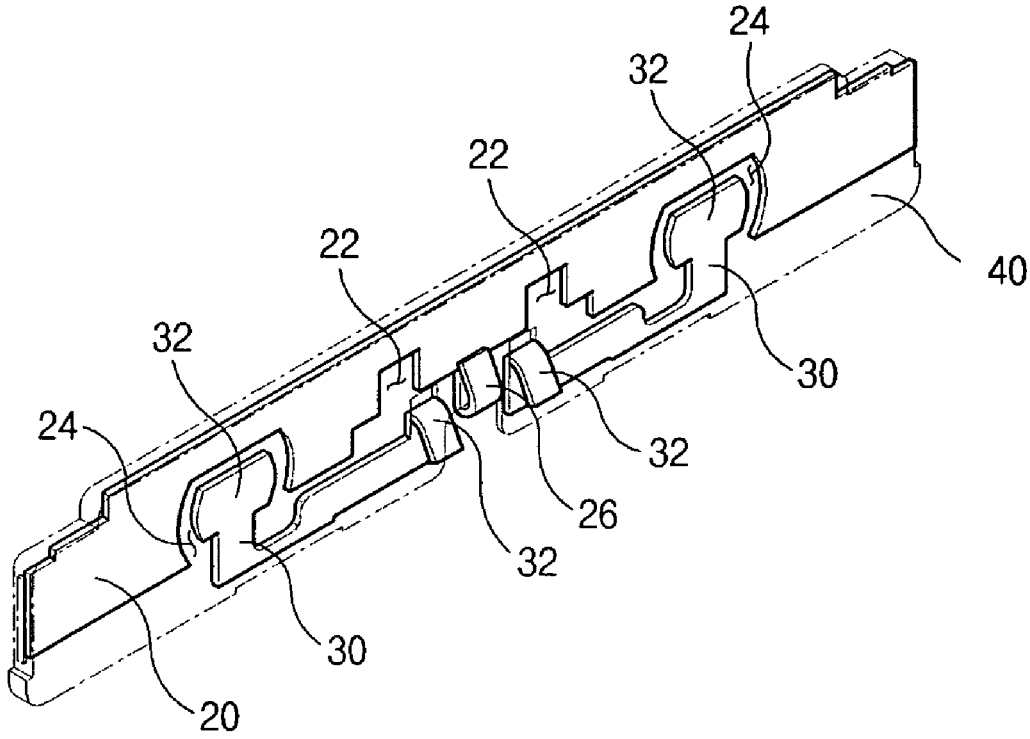
FIG. 3 is a perspective view illustrating the inside of the side key module shown in FIG. 2.

And, as shown in FIG. 3, each of the second plates 30 may include an expansion 34 that can be accommodated in the second cut-out space 24, contacting with the metal dome 10. The expansions 34 of the second plates 30 contribute to enlarging a contact area with the metal domes 10. The expansions 34 may be resembled in the second cut-out spaces.

The body 40 is provided to accommodate the first and second plates 20 and 30 therein. The body 10 may be formed in one with the first and second plates 20 and 30 by an injection molding process. In this case, after bending the first and second contactors 26 and 32 of the first and second plates 20 and 30, the body 40 is formed by way of the injection molding process.

The body 40 may include stepped corners 46 at both top edges. The stepped corners 46 are provided for guiding the side key module 1 into the inside of the mobile communication terminal when fabricating the side key module 1 in the mobile communication terminal, substantially preventing the side key module 1 from being reversely inserted into the mobile communication terminal.

The metal domes 10 are combined to a side of the body 40. If the side key 3 is pressed toward the PCB 5, the metal dome 10 is transformed thereto to enable the first and second plates 20 and 30 to be electrically connected with each other. Being elastically transformed, the metal dome 3 returns to its original form if pressure applied to the side key 3 is removed and thereby the side key 3 returns to its original position.

In detail, the metal dome 10 is transformed to contact with the expansion 34 of the second plate 30, as well as the face of the first plate 20 including the second cut-out space 24. If the metal dome 10 is pressed, the edge of the metal dome 10 contacts with the first plate 20 and the center of the metal dome 10 contacts with the expansion 34 to electrically connect the first plate 20 with the second plate 30.

The metal dome 10 may be configured in various forms. For instance, the metal dome 10 may be shaped in a hemisphere capable of maintaining restoring force.

Figure 4:
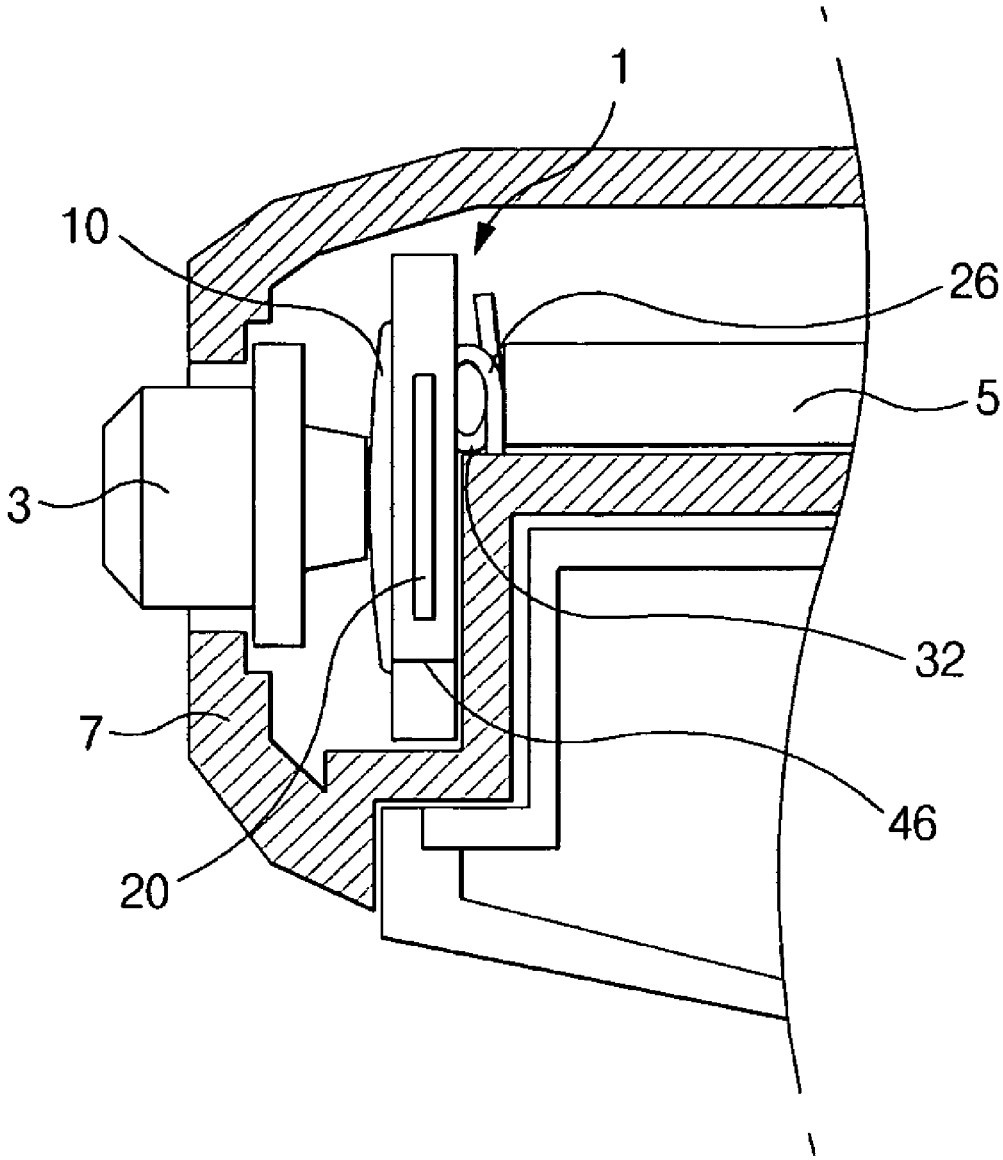
FIG. 4 is a section partly illustrating the mobile communication terminal in which the side key module of FIG. 1 is installed.

Now, referring to FIGS. 4, 5A and 5B, a combination feature between the side key module 1, the side key 3 and the PCB 5 in a mobile communication terminal 7 will be described.

The side key 3 is installed on a side of the mobile communication terminal 7. The PCB 5 is set in the mobile communication terminal 7. The side key module 1 is disposed between the side key 3 and the PCB 5.

Figure 5:
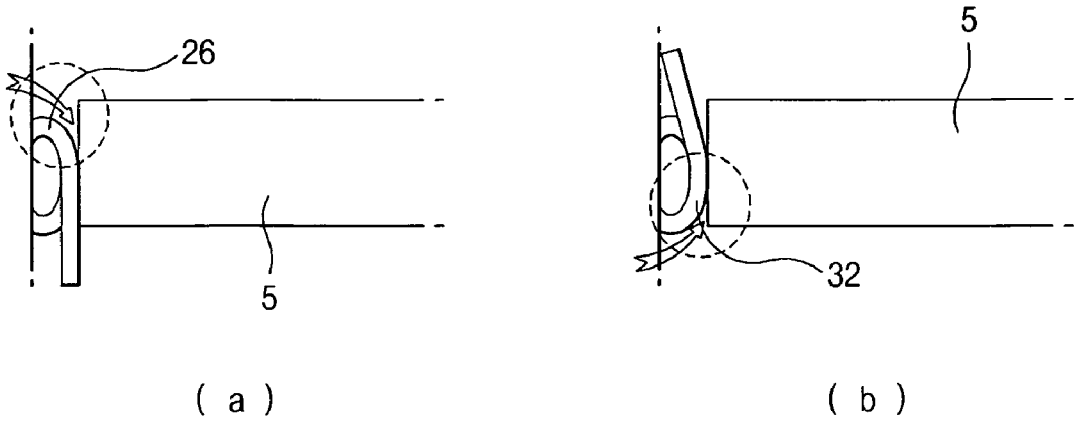
FIGS. 5A and 5B are schematic views illustrating directions of the force pressing a PCB by contactors of the side key module.

In this case, the first and second contactors, 26 and 32, of the first and second plates 20 and 30 contact with a side of the PCB 5, especially pressing the upper and lower side ends of the PCB 5 (refer to FIG. 5). As the first and second contactors, 26 and 32, are pressing the side of the PCB 5 in directions different to each other, the PCB 5 is stably fixed to the combination in the mobile communication terminal 7. Thus, it substantially prevents disconnection between the side key 3 between the PCB 5 because the PCB 5 is kept without separation from the side key module 1 even when there is an impact to the mobile communication terminal 7.

Figure 6:
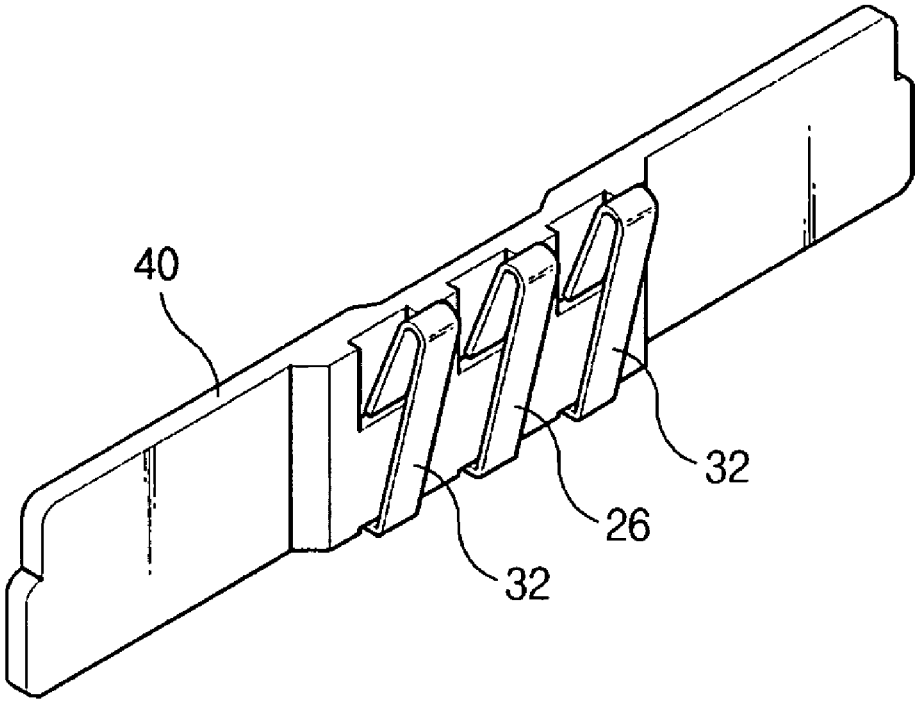
FIG. 6 is a rear perspective view of a side key module of a mobile communication terminal in accordance with another embodiment of the present invention.
Figure 7:
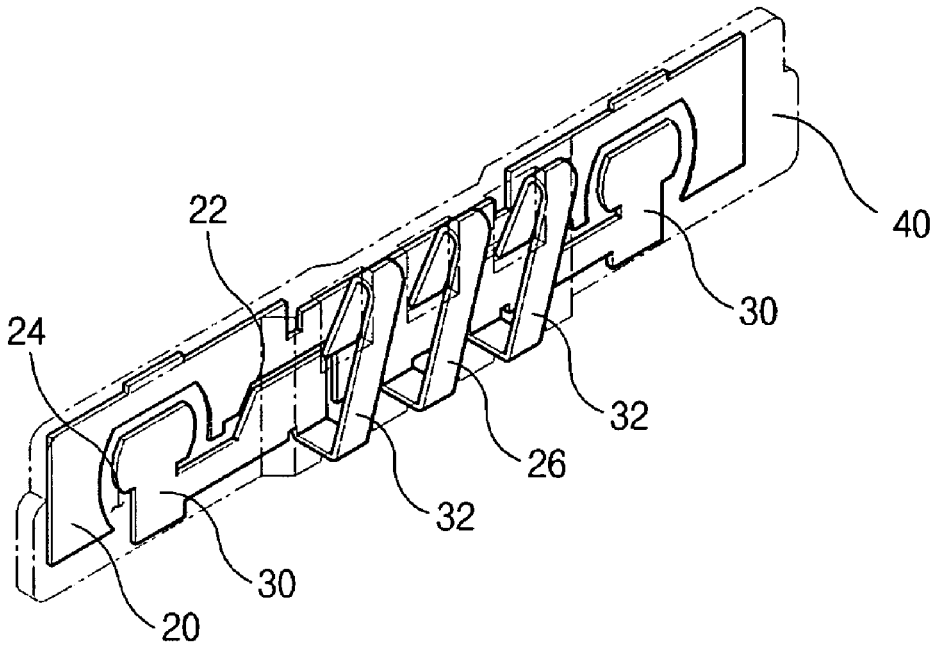
FIG. 7 is a perspective view illustrating the inside of the side key module shown in FIG. 6.

FIG. 6 perspectively illustrates the rear of a side key module of a mobile communication terminal in accordance with another embodiment of the present invention, and FIG. 7 perspectively illustrates the inside of the side key module shown in FIG. 6.

The side key module shown in FIGS. 6 and 7 will be described on the feature different from the former embodiment shown in FIGS. 1 through 3.

Referring to FIGS. 6 and 7, the first contactor 26 of the first plate 20 and the second contactors 32 of the second plates 30 are bended upward from the lower ends of the first and second plates 20 and 30. For this structure, the first and second contactors, 26 and 32, may be bended after completing an injection molding process if the body 40.

In this embodiment, the reason of joining the first and second contactors 26 and 32 to the lower ends of the first and second plates 20 and 30 is for permitting the first and second contactors 26 and 32 to be spread before an injection molding process of the body 40. Comparatively, the former embodiment may not enable the first and second plates 20 and 3*o* 5*o* be on the same plane under the condition of spreading the first and second contactors 26 and 32.

Here, it should be understood that bending the first and second contactors 26 and 32 after the injection molding process of the body 40 is more advantageous to rigidity than conducting the injection molding process of the body 40 after bending the first and second contactors 26 and 32.

For that reason, in this embodiment, the first and second contactors 26 and 32 are bended after the injection molding process for the first plate 20, the second plate 30 and the body 40 in the condition of spreading the first and second contactors 26 and 32.

Figure 8:
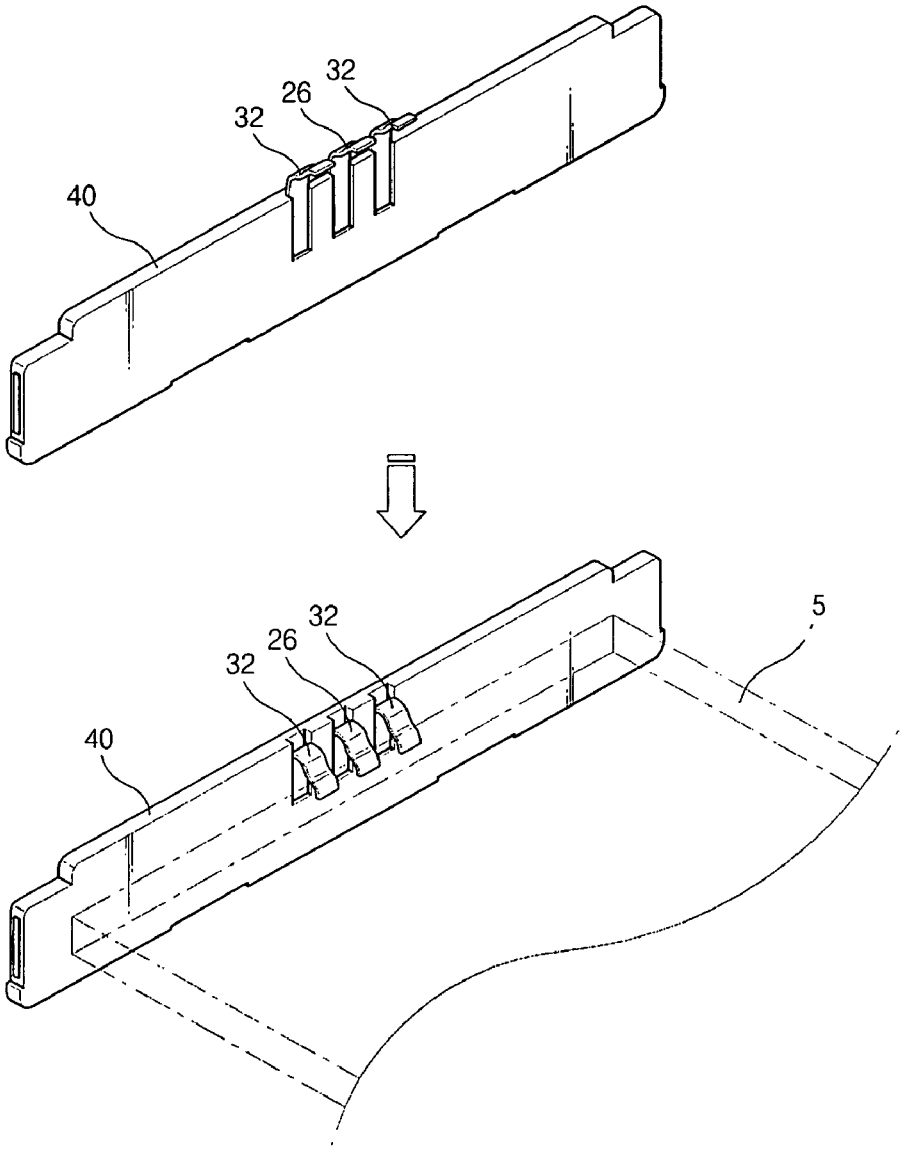
FIGS. 8 through 10 are rear perspective views of side key modules for mobile communication terminals in accordance with other embodiments of the present invention.
Figure 9:
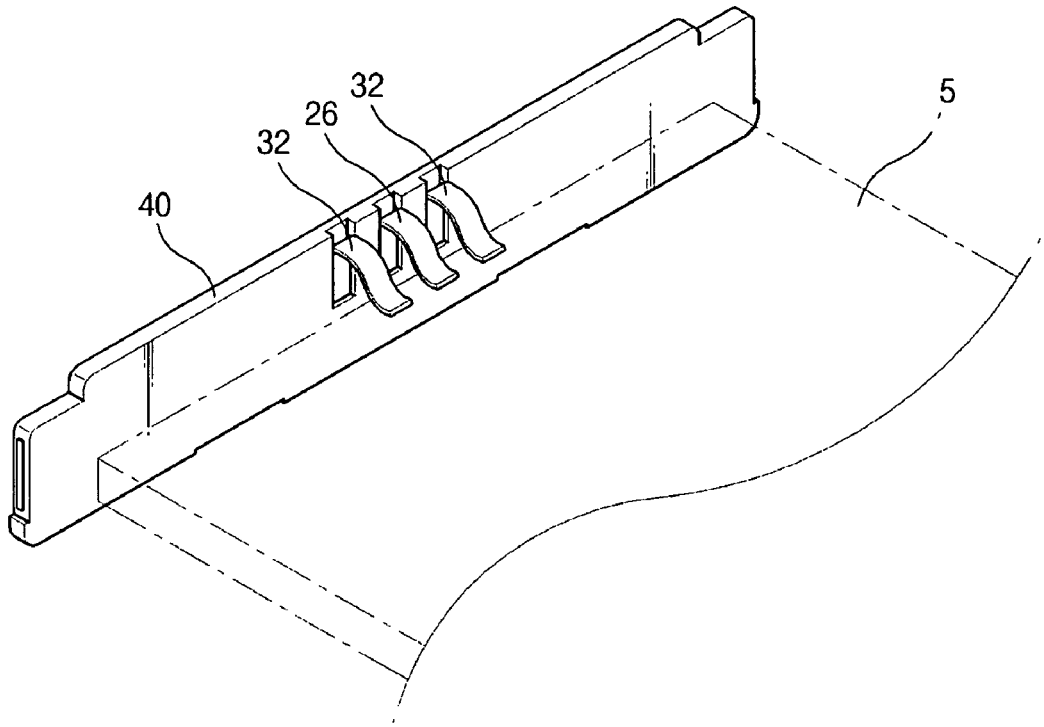
Figure 10:
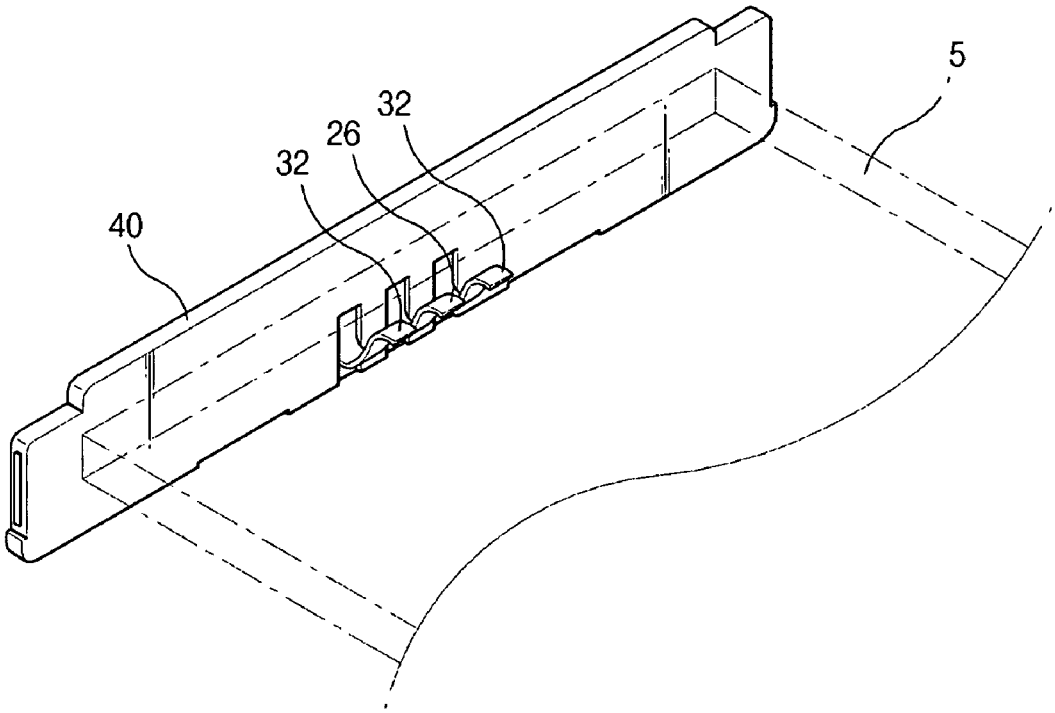

In addition, FIGS. 8 through 10 perspectively illustrate the rears of side key modules for mobile communication terminals in accordance with other embodiments of the present invention.

First, referring to FIG. 8, the first and second contactors 26 and 32 may be bended downward from the upper ends of the first and second plates 20 and 30. In detail, after completing the injection molding process while the first and second contactors 26 and 32 are being spread, the first and second contactors 26 and 32 are bended down. In this case, the first and second contactors 26 and 32 are arranged to contact with a side of the PCB 5.

Referring to FIG. 9, the first and second contactors 26 and 32 may be bended to contact with the top side of the PCB 5. Moreover, referring to FIG. 10, the first and second contactors 26 and 32 may be bended to contact with the bottom side of the PCB 5.

According to the side key modules for mobile communication terminals, it is convenient for fabrication without a soldering process.

Further, since the contactors of the first and second plates are contactly pressing upper and lower side ends of the PCB to strongly fix the PCB, it is possible to substantially prevent disconnection even when there is an impact.

Moreover, since the contactors of the first and second plates are bended after an injection molding process of the body, it improves rigidity of the contactors than the case of bending the contactors before the injection molding process.

Although exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A side key module interposed between a side key, which is installed at a side of a mobile communication terminal, and a PCB set in the mobile communication terminal, the side key module comprising:

a first plate made of conductive material configured in a lengthwise form including a cut-out space of a predetermined area and contacting with the PCB;

a second plate made of conductive material configured in the same plane with the first plate and disposed in the cut-out space of the first plate, contacting with the PCB;

a body accommodating the first and second plates; and a metal dome joining with a side of the body and enabling the first and second plates to be electrically connected together by contacting with the first and second plates if the side key is pressed.

2. The side key module according to claim 1, wherein the body is formed in one with the first and second plates by means of an injection molding process.

3. The side key module according claim 1, wherein the first and second plates are bended toward the PCB and have first and second contactors steadily contacting with the PCB.

4. The side key module according to claim 2, wherein the first and second plates are bended toward the PCB and have first and second contactors steadily contacting with the PCB.

5. The side key module according to claim 3, wherein the first contactor is bended upward from a lower end of the first plate and the second contactor is bended downward from an upper end of the second plate, or the first contactor is bended downward from an upper end of the first plate and the second contactor is bended upward from a lower end of the second plate.

6. The side key module according to claim 4, wherein the first contactor is bended upward from a lower end of the first plate and the second contactor is bended downward from an upper end of the second plate, or the first contactor is bended downward from an upper end of the first plate and the second contactor is bended upward from a lower end of the second plate.

7. The side key module according to claim 5, wherein the first contactor is formed to press an upper or lower side end of the PCB and the second contactor is formed-to press the lower or upper side end of the PCB.

8. The side key module according to claim 6, wherein the first contactor is formed to press an upper or lower side end of the PCB and the second contactor is formed to press the lower or upper side end of the PCB.

9. The side key module according to claim 3, wherein the first and second contactors are bended upward from lower ends of the first and second plates.

10. The side key module according. to claim 4, wherein the first and second contactors are bended upward from lower ends of the first and second plates.

11. The side key module according to claim 10, wherein the first and second contactors are bended after completing the injection molding process for the body.

12. The side key module according to claim 10, wherein the first and second contactors are bended after completing the injection molding process for the body.

13. The side key module according to claim 1, wherein the body comprises: stepped corners formed at both top edges and guiding the side key module into the mobile communication module.

14. The side key module according to claim 2, wherein the body comprises: stepped corners formed at both top edges and guiding the side key module into the mobile communication module.

* * * * *